United States Patent [19]

Nishikawa

[11] 4,191,852

[45] Mar. 4, 1980

[54] STEREOPHONIC SENSE ENHANCING APPARATUS

[75] Inventor: Masao Nishikawa, Seto, Japan

[73] Assignee: Shin-Shirasuna Electric Corporation, Nagoya, Japan

[21] Appl. No.: 906,564

[22] Filed: May 16, 1978

[51] Int. Cl.[2] ..... H04R 5/04

[52] U.S. Cl. ..... 179/1 G

[58] Field of Search ..... 179/1 G, 1 GQ, 100.4 ST, 179/100.1 TD; 84/DIG. 27

[56] References Cited

U.S. PATENT DOCUMENTS

| | | | |
|---|---|---|---|
| 3,164,676 | 1/1965 | Brunner | 179/1 G |
| 3,249,696 | 5/1966 | Van Sickle | 179/1 G |
| 3,725,586 | 4/1973 | Iida | 179/1 G |
| 3,849,600 | 11/1974 | Ohshima | 179/1 G |
| 3,892,624 | 7/1975 | Shimada | 179/1 G |
| 3,943,293 | 3/1975 | Bailey | 179/1 G |

FOREIGN PATENT DOCUMENTS

| | | | |
|---|---|---|---|
| 2308267 | 11/1976 | France | 179/1 G |
| 48-23401 | 3/1973 | Japan . | |
| 49-3921 | 1/1974 | Japan . | |

OTHER PUBLICATIONS

"Circuits" in *Radio Electronics,* Mar. 1973, p. 104.

*Primary Examiner*—Douglas W. Olms
*Attorney, Agent, or Firm*—Wenderoth, Lind & Ponack

[57] ABSTRACT

An apparatus fo effectively increasing stereophonic sense when the distance between left and right loudspeakers is small is disclosed.

This apparatus enlarges the apparent distance between the left and the right sources of sound by vectorially adding the sound signals of the left and the right channels. This apparatus has a phase reversing circuit, a mixer circuit, and a band-pass filter in each of the left and the right channels. The phase reversing circuit is a negative feedback type tone control circuit, the mixer circuit includes a stereophonic sense increasing effect on-off switch device capable of switching load impedances, and the band-pass filter passes a sound frequency band that is useful for increasing the stereophonic sense.

5 Claims, 7 Drawing Figures

STEREOPHONIC SENSE ENHANCING APPARATUS

BACKGROUND OF THE INVENTION

The present invention relates to a stereophonic reproducing apparatus and, more particularly, to the stereophonic reproducing apparatus in which signals of each of the left and the right channels are vectorially added by means of a mixer circuit to thereby increase stereophonic sense.

In a conventional stereophonic reproducing apparatus, left and right sound signals are applied from a source of the stereophonic signals to respective left and right loudspeaker systems and are radiated as reproduced sounds independent from each other. This type of conventional stereophonic reproducing apparatus, however, has a disadvantage because the smaller the distance between the left and the right speakers is, the poorer becomes the stereophonic sense. Accordingly it has been proposed to enlarge the apparent distance between the left and the right sound sources by mixing the left and the right sound signals, which have heretofore been supplied independently to the left and the right speakers, with an appropriate ratio m by means of mixer circuits, producing a left sound signal $A_{L1}=A_L-m\cdot A_R$ and a right sound signal $A_{R1}=A_R-m\cdot A_L$ (wherein $A_L$ is the left sound input signal and $A_R$ is the right sound input signal, and the negative sign denotes simply a reversed phase), and supplying the left and the right sound signals thus mixed with each other to the left and the right speaker systems, respectively, for sound reproduction.

The principle of enlarging the apparent distance between the left and right sound sources will now be described with reference to FIG. 1. The left and the right sound signals $A_{L1}$ and $A_{R1}$ are applied as respective inputs to the left speaker 1 and the right speaker 2, which are spaced apart by the distance d. When the sounds radiated from the respective left and right speakers are listened to at a listening position 3, for example on the perpendicular bisector of the straight line connecting the centers of both the speakers (assuming that each of the left and the right sound sources and the listening position may be approximated by a point), the left sound pressure vector $(P_L-mP_R)\vec{a}$ and the right sound pressure vector $(P_R-mP_L)\vec{b}$ (where $P_L$ is the sound pressure produced by the signal $A_L$, $P_R$ is the sound pressure produced by the signal $A_R$, and $\vec{a}$ and $\vec{b}$ are unit vectors directed from the left and the right speakers, respectively, to the listening position (3) are added to produce a left signal sound pressure $P_L(\vec{a}-m\vec{b})$ and a right signal sound pressure $P_R(\vec{b}-m\vec{a})$. In other words, the stereophonic sounds are heard at the listening position 3 as if from the direction shown by broken lines, namely as if the sound sources were spaced apart by an apparent distance which is greater than the actual distance between the sound sources. Accordingly, by selecting an appropriate mixing ratio m, a satisfactory stereophonic sense is obtained even when the distance d between the left and the right speakers is relatively small.

However, the mere mixing of the left and the right sound signals in reversed phase as described above, in which the sound signals are mixed uniformly over the entire band, is disadvantageous because the sound volume is decreased in the low and the medium frequency ranges, the orientation of the sound source is from time to time varied in the high frequency range and a stereophonic reproducing apparatus for performing this kind of mixing operation, in which the left and the right sound signals to be mixed are obtained from the output of a pre-amplifier, must be provided particularly with a phase reversing circuit and, accordingly, necessitates additional costs.

Accordingly, an object of the present invention is to provide a stereophonic reproducing apparatus which is capable of obviating the above-described disadvantages such as reduction in sound volume in the low and the medium frequency ranges and variation in orientation of the sound sources in the high frequency range without any special phase reversing circuit which is, accordingly, less expensive, and is capable of mixing the left and the right sound signals in a reversed phase thereby increasing the stereophonic sense.

SUMMARY OF THE INVENTION

In the stereophonic reproducing apparatus according to the present invention, the left and the right input signals appearing at the input terminals of the phase reversing circuits provided in the respective left and the right channels are fed through band-pass filter circuits for selectively attenuating the high and the low frequency ranges of the respective signals to the mixer circuits connected to the outputs of the phase reversing circuits of the opposite channels, to produce a mixed signal of the left signal in a reversed phase and the filtered right signal in a normal phase and a mixed signal of the right signal in a reversed phase and the filtered left signal in a normal phase. These mixed signals are applied to the left and right speakers respectively, thereby economically and efficiently providing an increased stereophonic sense effect. Further, in the apparatus according to the present invention, these mixer circuits are provided with switches for selecting turning the mixer "on" or "off" and for switching the load impedances so as to provide a relatively small load impedance in the "off" state and a relatively large load impedance in the "on" state, thereby preventing reduction in sound volume during mixing.

BRIEF DESCRIPTION OF THE DRAWINGS

The invention will be better understood from the following description taken in connection with the accompanying drawings in which.

PREFERRED EMBODIMENTS OF THE INVENTION

Figure 1:
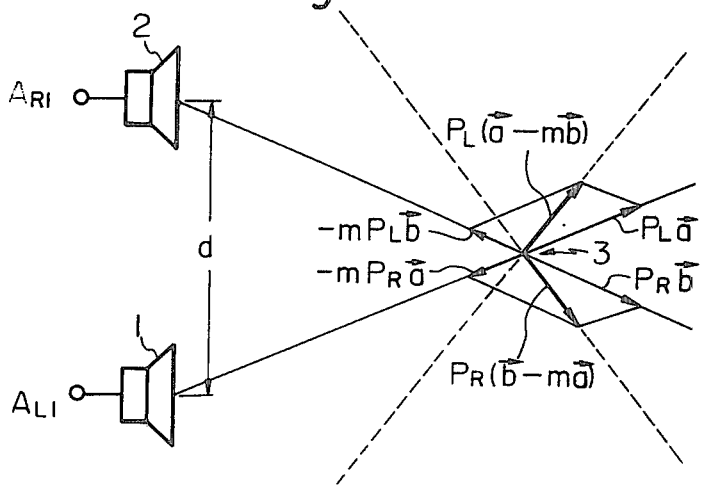
FIG. 1 is a schematic illustration of the principle of stereophonic reproduction by vectorial composition.

Referring now to the drawings, the preferred embodiment of the present invention will be described in detail.

Figure 2:
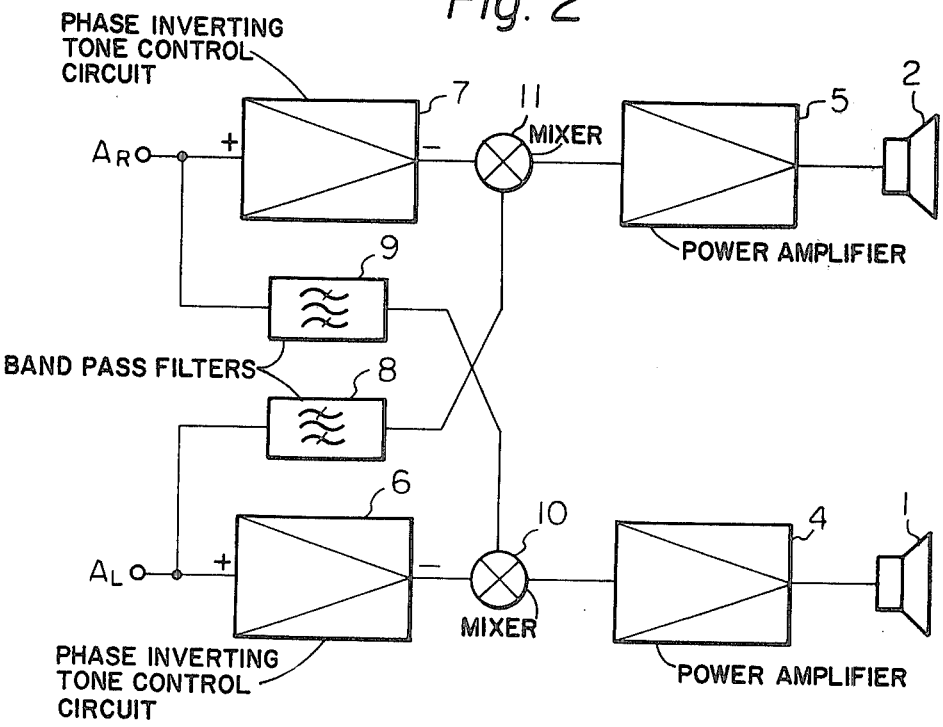
FIG. 2 is a block diagram of an embodiment of the stereophonic reproducing apparatus according to the present invention.

An embodiment of the stereophonic reproducing apparatus according to the present invention is shown in a block diagram in FIG. 2.

The left and the right power amplifier circuits 4 and 5 are of a conventional type for power amplifying input signals and actuating the respective left and right loud speakers 1 and 2 to produce sound. Tone control circuits 6 and 7 are of conventional negative feedback type for controlling when necessary the volume of the high and/or low frequency ranges of the input sound signals without affecting the volume of the medium range and for reversing the phase of the input sound signals 180 degrees. Band-pass filters 8 and 9 attenuate only the high and the low frequency ranges of the input sound signals. Mixer circuits 10 and 11 are for mixing the output signals from the tone control circuits and the output signals from the band-pass filters, and include mixing on-off switches for switching the load impedances of the tone control circuits for correcting the volume during mixing.

Figure 3:
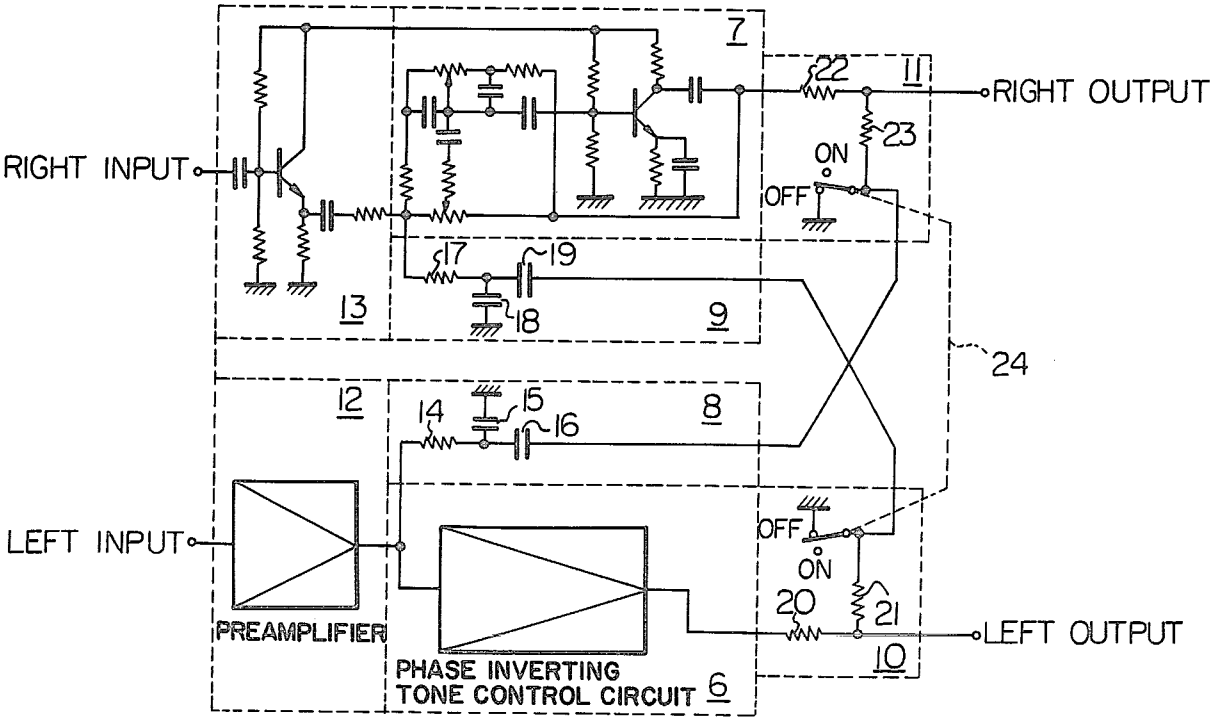
FIG. 3 is a circuit diagram showing in more detail the circuit of the apparatus of FIG. 2.

The embodiment of FIG. 2 is shown in more detail in a circuit diagram in FIG. 3. For simplification, like parts are denoted by the same reference numerals and the left signal system is shown partially in block form in FIG. 3.

In FIG. 3, left and right channel preamplifier circuits 12 and 13 and the negative feedback type tone control circuits 6 and 7 may be of known construction. A resistance 14 has one terminal connected to the junction point between the input buffer amplifier circuit 12 and the tone control circuit 6 of the left channel. The opposite terminal of resistance 14 is grounded through a capacitor 15 and connected through a capacitor 16 to the movable contact of the right channel mixing on-off switch 24 so as to form the band-pass filter 8 together with the capacitors 15 and 16. A resistance 17 has one terminal connected to the junction point between the input buffer amplifier circuit 13 and the tone control circuit 7 of the right channel. The opposite terminal of resistance 14 is grounded through a capacitor 18 and connected through a capacitor 19 to the movable contact of the left channel mixing on-off switch 24 so as to form the band-pass filter 9 together with the capacitors 18 and 19. The off-contacts of both the left and the right mixing on-off switches 24 are grounded. A resistance 20 is connected between the output of the left channel tone control circuit 6 and the left channel output terminal and a resistance 21 is connected between the left channel output terminal and the movable contact of the left channel switch 24 so as to form the left channel mixer circuit 10. A resistance 22 is connected between the output of the right channel tone control circuit and the right channel output terminal and a resistance 23 is connected between the right channel output terminal and the movable contact of the right channel switch 24 so as to form the right channel mixer circuit 11.

The operation of the apparatus according to the present invention will now be described. Since the left and the right circuits are identical in operation, only one of them will be described.

Figure 4:
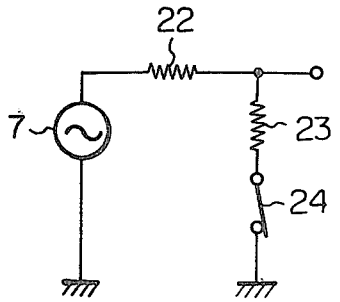
FIGS. 4 and 5 are equivalent circuit diagrams illustrative of the changes in the load impedance by switching from the "on" state to the "off" state.

When the mixing on-off switch 24 is turned OFF as shown in FIG. 3, the mixer circuit 11 becomes equivalent to the circuit shown in FIG. 4 and its output is divided only by the resistances 22 and 23. Assuming here that the output voltage of the tone control circuit 7 is V, the voltage of the output terminal is Vo, the value of the resistance 22 is $R_1$ and the value of the resistance 23 is $R_2$, the following equation is satisfied:

$$Vo = \frac{R_2}{R_1 + R_2} \times V \quad (1)$$

Figure 5:
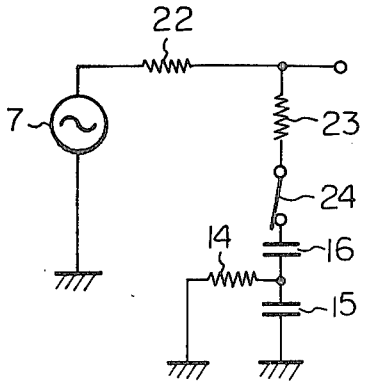

Then, when the switch 24 is turned ON, the mixer circuit 11 becomes equivalent to the circuit shown in FIG. 5 and the load impedance of the circuit 7 is increased. Assuming here that the value of the resistance 14 is $R_3$, the value of the capacitor 16 is C, and the impedance by the capacitor 15 is very high in comparison to $R_3$, the output voltage Vo is determined by the following equation:

$$Vo = \frac{\sqrt{(R_2 + R_3)^2 + (C)^2}}{\sqrt{(R_1 + R_2 + R_3)^2 + (C)^2}} \quad (2)$$

Accordingly, in the absence of a signal for adding from the opposite channel, the output voltage becomes greater, particularly in the medium and the low frequency ranges, when the switch is ON than when the switch is OFF.

Here, when an input is present in the opposite channel, for this example in the left channel, the input signal passes the resistance 14 which is the load of the buffer amplifier circuit and is attenuated in the high frequency range by the capacitor 15 and further attenuated in the low frequency range by the capacitor 16 and then applied to the mixer circuit 11. Accordingly, the left channel signal having a normal phase from band-pass filter 8 and the right channel signal having a reversed phase from the tone control circuit 7 are mixed together to produce a right composite signal.

In this embodiment, while the in-phase cancelling effect in the output for the case where the same signal is applied to both the left and the right channels is described as being 6 dB, it is not limited thereto.

Examples of the in-phase cancelling effect for the case where an in-phase signal is applied to the inputs of the left and the right channels will now be described with reference to FIGS. 6 and 7.

Figure 6:
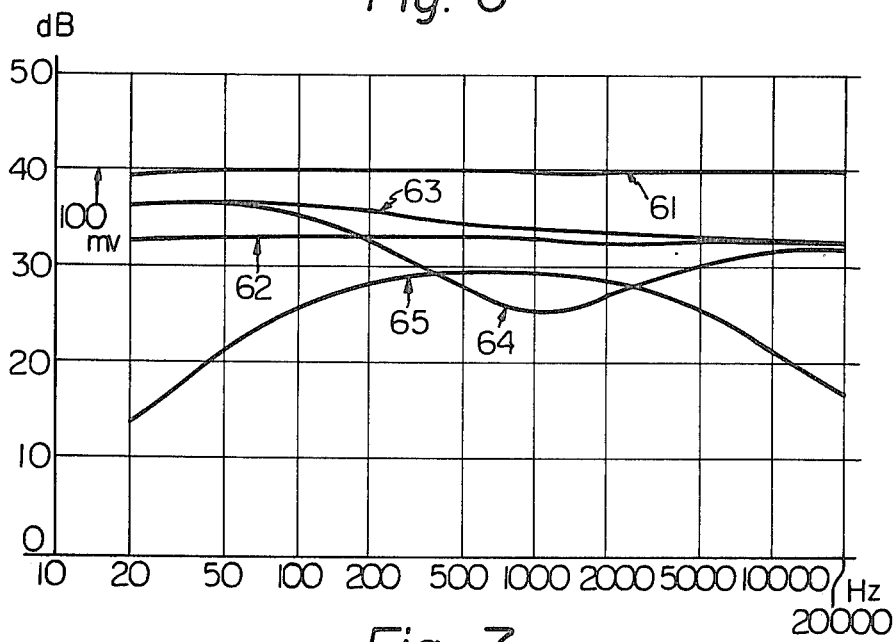
FIGS. 6 and 7 are graphs showing the effects in frequency characteristics in the embodiment of the present invention.

FIG. 6 is a graph showing the in-phase cancelling effect for the case where the frequency characteristic of the tone control circuit is flat. FIG. 7 is a graph showing the in-phase cancelling effect for the case where the frequency characteristic of the tone control circuit is either the greatest or the smallest in the high and the low frequency ranges. In FIGS. 6 and 7, the ordinate denotes a decibel scale with 40 dB equivalent to an output of 100 mV and the abscissa denotes a logarithmic frequency scale from 10 Hz to 20,000 Hz. Each input signal is 100 mV at the sound signal input terminal with the circuit to be measured not connected to the power amplifier circuit. The circuit constants of the mixer circuits are as shown in Table 1.

Table 1

| Component | Ref. Numeral | Unit | Value |
|---|---|---|---|
| Resistance | 14 | KΩ | 5.6 |
| " | 17 | " | 5.6 |
| " | 20 | " | 12 |
| " | 21 | " | 15 |
| " | 22 | " | 12 |
| " | 23 | " | 15 |
| Capicitor | 15 | nF | 5.6 |
| " | 16 | " | 47 |
| " | 18 | " | 5.6 |

Table 1-continued

| Component | Ref. Numeral | Unit | Value |
|---|---|---|---|
| " | 19 | " | 47 |

(where KΩ = $10^3$Ω, nF = $10^{-9}$F)

In FIG. 6, a curve 61 denotes the output of the tone control circuit, showing that the output signal is almost the same as the input signal. A curve 62 denotes the output of the mixer circuit for the case where the mixing switch 24 is turned OFF, showing that the output signal is almost the same as the input signal except that the signal level is approximately 7 dB lower than the level of the curve 61. A curve 63 denotes for the case where the mixing switch 24 is turned ON the output of the mixer circuit of the channel into which the signal is input without applying a signal to the opposite channel, showing that the output signal is amplified only in the medium and the low ranges because of the load impedance including the capacitors in series as described hereinbefore. A curve 64 denotes the output of the mixer circuit for the case where an in-phase signal is input to both channels and the mixing switch is turned ON, showing that the output signal is of the characteristic in which the input signal is attenuated only in the medium frequency range since the mixed signal applied from the opposite channel through the band-pass filter has a frequency characteristic attenuated in the high and the low frequency ranges as shown by curve 65.

Figure 7:
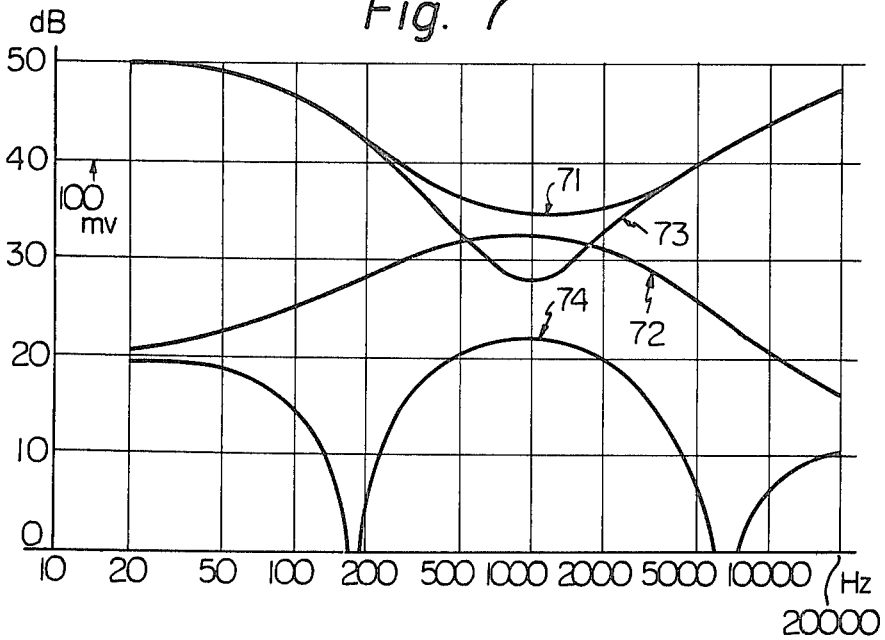

In FIG. 7, curves 71 and 72 represent the cases where the mixing switch is turned ON without applying a signal to the opposite channel. The curve 71 denotes the output of the mixer circuit for the case where the frequency characteristics of the tone control circuit amplify the high and the low frequency ranges to the maximum, and the curve 72 denotes the output of the mixer circuit for the case where frequency characteristics of the tone control circuit attenuates the high and the low frequency ranges to the minimum. A curve 73 denotes the output of the mixer circuit for the case where the in-phase signal is applied to the opposite channel in the state of the curve 71, showing that only the medium frequency range is attenuated. A curve 74 denotes the output of the mixer circuit for the case where the in-phase signal is applied to the opposite channel in the state of the curve 72, showing attenuation in the medium frequency range and further extreme attenuation at two other points. This effect is achieved because the curve 72 resembles the curve 65 of FIG. 6. In general stereophonic reproduction, however, since it is quite rare to place the frequency characteristics of the tone control circuit for extreme attenuation of the high and the low frequency ranges as in the curve 72 and since such operation is done for the purpose of increasing articulation only when much noise is present in the high and low frequency ranges, this effect may be considered to have no substantial effect on the sense of hearing.

In the stereophonic reproducing apparatus according to the present invention, as described above, the stereophonic sense is increased by the provision of simple CR load circuits as mixer circuits and band-pass filters without the provision of any special phase reversing circuit. Further, the provision of the mixing on-off switches as load impedance switches prevents the medium and the low ranges from being attenuated by the mixing of the in-phase signals applied to the left and the right channels, thereby preventing reduction in the general sense of hearing and even amplifying it.

While we have shown and described a specific embodiment of our invention with reference to FIGS. 3 to 7 and Table 1, it will be understood that the foregoing description is merely for the purpose of illustration and not for the purpose of limitation of the invention.

I claim:

1. A stereophonic reproducing apparatus for vectorially composing left and right sound signals applied to left and right loudspeakers, respectively, comprising:
   (a) a first and a second phase reversing circuits each having inputs for receiving the left and the right sound input signals and output;
   (b) a first band-pass filter having an input connected to the input of said first phase reversing circuit and an output;
   (c) a second band-pass filter having an input connected to the input of said second phase reversing circuit and an output;
   (d) a first mixer circuit having a first input connected to the output of said first phase reversing circuit, a second input connected to the output of said second band-pass filter, and an output; and
   (e) a second mixer circuit having a first input connected to the output of said second phase reversing circuit, a second input connected to the output of said first band-pass filter, and an output.

2. A stereophonic reproducing apparatus as set forth in claim 1, wherein each of said first and second phase reversing circuits is a negative feedback tone control circuit.

3. A stereophonic reproducing apparatus as set forth in claim 1, wherein each of said first and second mixer circuits includes a load impedance switching device comprising resistances and a switch.

4. A stereophonic reproducing apparatus as set forth in claim 3, wherein each of said first and second phase reversing circuits is a negative feedback tone control circuit.

5. A stereophonic reproducing apparatus as set forth in claim 4, wherein each of the switches of the load impedance switching devices of said first and second mixer circuits has a contact interlocked to the corresponding contact of the other switch.

* * * * *